United States Patent [19]

Assanti

[11] 4,217,740

[45] Aug. 19, 1980

[54] VARIABLE MOSAIC PATTERN WITH INTERCHANGEABLE COMPONENTS

[76] Inventor: Philip N. Assanti, 34 Gamache Rd., Derry, N.H. 03038

[21] Appl. No.: 915,143

[22] Filed: Jun. 7, 1978

[51] Int. Cl.[2] ..... E04B 2/00

[52] U.S. Cl. ..... 52/311; 52/590

[58] Field of Search ..... 273/156, 157 R; 52/590, 52/311, 315, 390, 392; 35/27

[56] References Cited

U.S. PATENT DOCUMENTS 928,320 7/1909 Moore ..... 52/311

FOREIGN PATENT DOCUMENTS 1276032 10/1961 France ..... 52/311

1094632 12/1967 United Kingdom ..... 52/315

OTHER PUBLICATIONS

New Mathematical Pastimes by MacHahon by Cambridge at the University Press, 1921, pp. 88, 89, 90, 97, 98, 99.

*Primary Examiner*—John E. Murtagh

*Attorney, Agent, or Firm*—Clarence A. O'Brien; Harvey B. Jacobson

[57] ABSTRACT

A variable mosaic pattern formed from interfitting blocks formed into standard shape is disclosed groups with curved or serpentine shapes. Interchangeability of the groups of the standard shapes permits easy installation, and production machinery presently available permits low cost manufacturing of the interchangeable components, which can be made of a suitable plastic molded from suitably shaped molds or stamped out on presses, cut from slabs of stone, or formed by other suitable means. The interchangeable components can be assembled indefinitely in any direction in an ever-changing mosaic pattern creating a random decorative effect.

6 Claims, 3 Drawing Figures

VARIABLE MOSAIC PATTERN WITH INTERCHANGEABLE COMPONENTS

BACKGROUND OF THE INVENTION

1. Field of the Invention

The invention relates to a mosaic pattern with interchangeable components, more particularly, to building construction materials for forming floors, walls, ceilings, or the like, from individual blocks of plastic, stone, wood, or other suitable construction materials. Interfitting blocks having serpentine shapes with arcuate edges are assembled into groups constituting such interchangeable components. A variable mosaic pattern results, creating a random decorative effect.

2. Description of the Prior Art

It is known in the prior art to use patterns, and particularly patterns for forming a mosaic, particularly for use in construction, as is shown by Contratto in U.S. Pat. No. 2,732,597, where match wood splints having a rhombus-shaped cross section are horizontally arranged and joined. Lowry et al in U.S. Pat. No. 1,637,580 assemble a series of squares, rectangles, quadrangles, pentagons to produce a tile wall or floor, and patents to Furness, U.S. Pat. Nos. 527,961 and 565,734, show patterns of exact repetition of square units locked together with a pillar and ball lock or variation thereof, and similar locking construction is shown by Nilsson in U.S. Pat. No. Re. 12,483 and by Hopkinson in U.S. Pat. No. 1,158,051. Gilbert in U.S. Pat. No. 3,665,617 assembles nine distinct pieces to form a definite square or rectangle array.

Other patents of interest for showing the state of the prior art include the following:

U.S. Pat. Nos.

2,882,689—Apr. 21, 1959—Huch et al 3,696,566—Oct. 10, 1972—Langner 3,981,505—Sep. 21, 1976—Odier

SUMMARY OF THE INVENTION

The present invention overcomes an undesirable impression of repetitiveness in prior art mosaic patterns constructed from blocks or pieces of regular design. Furthermore, the present invention has the advantage of providing low cost serpentine blocks which can be cast, molded or cut in standard patterns.

Accordingly, it is an object of the present invention to produce a variable mosaic pattern with interchangeable component blocks, especially for use in building construction, such as for floors, walls, ceilings, and the like.

Another object of the invention is to improve upon prior art mosaic patterns based upon regular geometric shapes by providing serpentine blocks of interchangeable groups to create such patterns having a random pattern effect.

Still another object of the invention is to provide a variable mosaic pattern of serpentine blocks having arcuate outlines and easily installable to form a surface of indefinite extent.

Yet another object of the invention is to provide a low cost variable mosaic pattern of serpentine blocks of stone having arcuate outlines.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
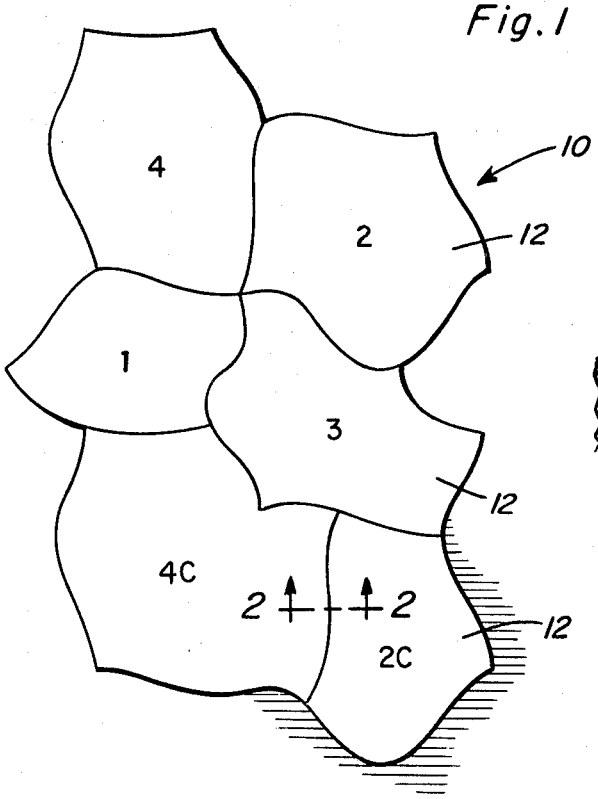
FIG. 1 is a plan view showing assembly of six blocks comprising the surface covering of the present invention interfitting to form part of a floor covering.

In FIG. 1 a portion of a surface covering is designated generally by the numeral 10, and surface covering is made up of six interfitting blocks 12, each of a separate shape and forming a contiguous whole. Each of blocks 12 is identified by a numeral, or a numeral and letter, corresponding uniquely to the shape of that block. Each of blocks 12 has substantially parallel top and bottom faces 14 and 16, respectively (see FIG. 2). Blocks 12 can be constructed of slate or stone, and cut into standard patterns, such as those illustrated in FIG. 1, by a wire saw according to conventional methods well-known in the art of stone cutting. Alternatively, blocks 12 can be stamped out on presses which are conventional and well-known in the art of manufacturing linoleum. Still another method of manufacturing blocks 12 is through molding with terra-cotta, terrazzo, or other molds, photographic imprinting, or other means well-known to those skilled in the art. Because a uniformity of pattern is used, the cost of manufacture is minimized by utilization of economies of scale.

Figure 2:
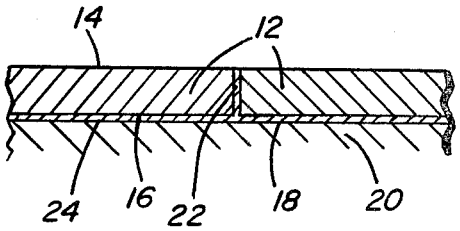
FIG. 2 is a sectional view taken substantially upon a plane passing along section line 2—2 in FIG. 1 showing details of adjacent blocks when applied to a surface and jointed with a suitable adhesive.

FIG. 2 shows the manner of joining blocks 12 to each other and upon an exposed surface 18 of a base 20, such as the subflooring of a building. Blocks 12 are bonded together by utilizing a bonding agent or grouting to fill gap or void 22 between blocks, and the same or a different bonding agent or grouting is used to apply and retain blocks 12 upon surface 20 in the region 24 therebetween.

Figure 3:
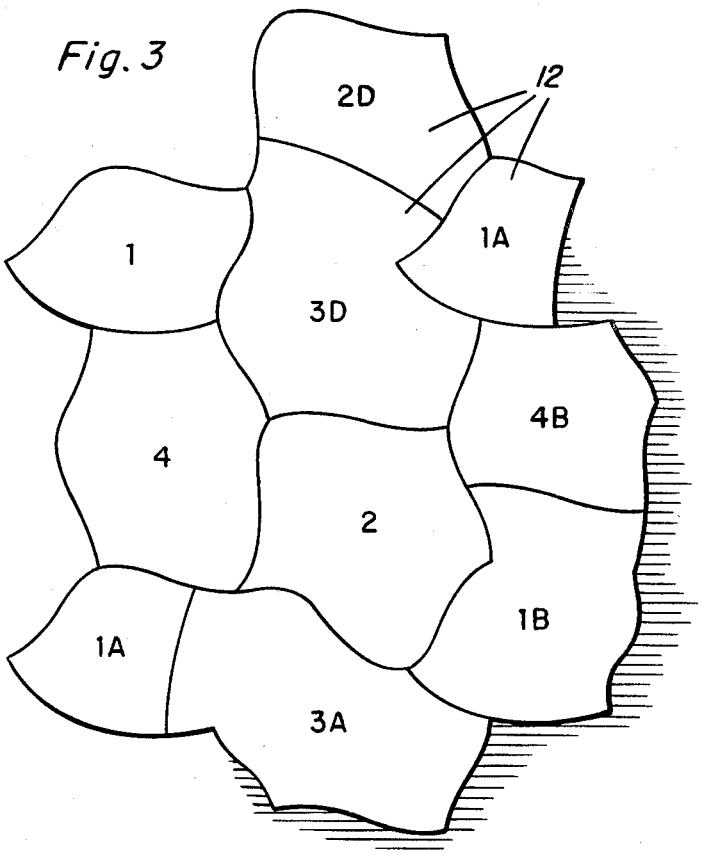
FIG. 3 is a top plan view of a portion of a surface specifically illustrating substitution of pairs of adjacent blocks for pairs of blocks in FIG. 1 to illustrate novel features of the present invention.

FIG. 3 shows a pattern created from blocks 12, where numerals or a combination of numerals and letters denote individual block patterns. Interchangeability of block pairs is best observed by comparison of FIG. 1 with FIG. 3. Considering first the pair of blocks numbered 2 and 3 in FIG. 1, it is easily observed that blocks 2D and 3D in FIG. 3, although individually having a different shape from blocks 2 and 3, respectively, display the same shape about each pair's periphery. Similarly, comparison of blocks 4C and 2C in FIG. 1 shows that the outer periphery of the pair of blocks 4C and 2C is identical with the outer periphery of individually distinct blocks 4 and 2 in FIG. 3. As indicated, the pair of blocks 1 and 3 in FIG. 1 and the pair of blocks 4 and 2 are always arranged in the same generally horizontal relationship and can be expanded horizontally and vertically with the blocks having the same alphabetical letter associated with the numerals in each of the above mentioned pairs being substituted. For example, blocks 4C and 2C can be substituted for blocks 4 and 2, blocks 1A and 3A can be substituted for blocks 1 and 3, etc. However, blocks with different letters cannot be used as a pair. For example, blocks 4C and 2D could not be substituted for blocks 4 and 2. Thus, a twelve piece variable interchangeable mosaic is designed to fit each abutting piece to infinity with the twelve blocks including blocks 1, 1A, 1B, 2, 2C, 2D, 3, 3A, 3D, 4, 4B and 4C. This is also a ten, eight, six or four piece variable interchangeable mosaic pattern. An example of a ten piece variable interchangeable mosaic would be blocks 1, 2, 3, 4, 1A, 3A, 1B, 4B, 2C, and 4C. Another ten piece unit would be 1, 2, 3, 4, 1B, 4B, 2C, 4C, 2D and 3D. An example of an eight piece unit is 1, 2, 3, 4, 1A, 3A, 1B, and 4B. An example of a six piece unit is 1, 2, 3, 4, 1A and 3A or the unit shown in FIG. 1. An example for a four piece unit is 1, 2, 3, 4 or 1, 3, 4C and 2C. It can be seen that any number of substitutions of block pairs having equivalent outer peripheries can be made. Consequently, each substitution of a pair of blocks with another pair having the same outer periphery but different members of the pair introduces an additional element of variety into the mosaic pattern obtainable. Introduction of such variations creates an impression of randomness, while the use of standard sizes of blocks permits application of mass production manufacturing techniques with cost savings resulting from economies of scale associated therewith.

It is to be noted that each of blocks 12 illustrated in FIGS. 1 and 3 has about its periphery at least one cusp. While it is possible to generate a geometric pattern of interlocking or interfitting components not having cusps, such as by use of tabs and compatibly formed recesses, it is preferred to use blocks wherein at least some blocks have one or more cusps. Such a pattern of serpentine outline associated with one or more cusps produces a visually satisfying effect useful for forming floors, walls, or other surfaces in building construction. Such a visual pattern completely eliminates any impression of repetition or straight line effect. Furthermore, the invention is not limited to any particular arrangement of groups of blocks. For example, a pattern as in FIG. 1 could be started with six separate and distinct shapes of blocks, and during extension thereof, the number of blocks reduced to four. Alternatively, a greater number of shapes, such as eight or more, could be introduced after starting construction. In fact, groupings of blocks having equivalent peripheral shapes can be changed at will, subject only to the restriction that interchangeability of groups be preserved.

Even greater variety in the effect created by the present invention can be obtained when blocks 12 are provided having a plurality of colors, giving an even greater variety of patterns which can be chosen by selection and arrangement of stone blocks by shape and by color. Furthermore, each of blocks 12 can be of non-uniform color, texture, or origin. For example, natural stone blocks of slate can be mixed with blocks formed from marble, granite, or other types of stone. Striations can be oriented in different directions of stone, linoleum or other materials making up blocks 12. With the use of the present invention, an extraordinary degree of variety in decorative effect obtainable can be easily achieved. Such variety is enhanced by the complete absence of standard geometric patterns, such as semi-circles, squares, straight line effects, repeating polygonal units, and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a surface covering comprising a plurality of interfitting blocks having substantially parallel top and bottom faces and edges interfitting with contiguous blocks, the improvement comprising blocks arrangeable into a variable mosiac pattern which forms said surface covering, the pattern being characterized by visual randomness and a random decorative effect, the blocks having arcuate edges and at least three different highly irregular shapes with no perpendicular axes of symmetry, the blocks being contiguously associable into one or more groups wherein at least one group of contiguous blocks is interchangeable with one or a plurality of other adjacent groups so as to create an appearance of visual randomnesss and avoid a recognizable appearance of repetitiveness or symmetry, the number of different highly irregular shapes being less than about 20, and each of said shapes having at least one cusp.

2. The surface covering of claim 1 wherein said group of contiguous blocks is a pair of contiguous blocks.

3. The surface covering of claim 1 wherein said surface covering comprises a substantially planar interior surface of the room of a building.

4. The surface covering of claim 3 wherein said blocks are stone or plastic and have a plurality of colors, whereby even greater variety of patterns is creatable and is enhanced by the complete absence of standard repetitive geometric patterns.

5. The surface covering of claim 3 wherein said blocks are made of moldable material.

6. The surface covering of claim 1 wherein said blocks have twelve different shapes.

* * * * *